US010553948B2

(12) United States Patent
Chia

(10) Patent No.: US 10,553,948 B2
(45) Date of Patent: Feb. 4, 2020

(54) MULTIBAND ANTENNA AND ELECTRONIC DEVICE WITH MULTIBAND ANTENNA

(71) Applicant: HON HAI PRECISION INDUSTRY CO., LTD., New Taipei (TW)

(72) Inventor: Kai-Wei Chia, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 178 days.

(21) Appl. No.: 15/869,117

(22) Filed: Jan. 12, 2018

(65) Prior Publication Data

US 2019/0181551 A1 Jun. 13, 2019

(30) Foreign Application Priority Data

Dec. 7, 2017 (CN) ..... 2017 1 1286617

(51) Int. Cl.

| | |
|---|---|
| ***H01Q 1/24*** | (2006.01) |
| ***H01Q 1/38*** | (2006.01) |
| ***H01Q 5/35*** | (2015.01) |
| ***H01Q 9/04*** | (2006.01) |
| ***H01Q 5/50*** | (2015.01) |
| ***H01Q 21/00*** | (2006.01) |
| ***H01Q 5/328*** | (2015.01) |

(52) U.S. Cl.

CPC ..... *H01Q 5/35* (2015.01); *H01Q 5/328* (2015.01); *H01Q 5/50* (2015.01); *H01Q 9/0435* (2013.01); *H01Q 21/0031* (2013.01)

(58) Field of Classification Search

CPC ..... H01Q 21/0031; H01Q 5/328; H01Q 1/24; H01Q 1/38; H01Q 5/35; H01Q 5/50; H01Q 9/0435

See application file for complete search history.

(56) References Cited

U.S. PATENT DOCUMENTS

| | | | | |
|---|---|---|---|---|
| 6,473,042 | B1 * | 10/2002 | Fang | G06F 1/1616 343/700 MS |
| 7,642,967 | B2 * | 1/2010 | Wang | H01Q 1/243 343/700 MS |
| 7,973,726 | B2 * | 7/2011 | Tseng | H01Q 1/243 343/700 MS |
| 9,190,713 | B2 * | 11/2015 | Eom | H01Q 1/243 |
| 9,325,070 | B1 * | 4/2016 | Obeidat | H01Q 9/0407 |
| 2007/0236396 | A1 * | 10/2007 | Gao | H01Q 1/243 343/702 |
| 2013/0241777 | A1 * | 9/2013 | Chang | H01Q 1/243 343/700 MS |

* cited by examiner

*Primary Examiner* — Tho G Phan
(74) *Attorney, Agent, or Firm* — ScienBiziP, P.C.

(57) ABSTRACT

An electronic device includes a base plate and a miniaturized multiband antenna. The multiband antenna is set on the base plate. The base plate includes a first side and a second side relative to the first side. The multiband antenna includes a first radiating part and a second radiating part. The first radiating part is set on the first side. The second radiating part is set on the second side. A gap is formed between the first radiating part and the second radiating part which facilitates a coupling oscillation between the first radiating part and the second radiating part, which enables the multiband antenna to work in at least one working band.

16 Claims, 5 Drawing Sheets

MULTIBAND ANTENNA AND ELECTRONIC DEVICE WITH MULTIBAND ANTENNA

CROSS-REFERENCE TO RELATED APPLICATIONS

This application claims priority to Chinese Patent Application No. 201711286617.4 filed on Dec. 7, 2017, the contents of which are incorporated by reference herein.

FIELD

The subject matter herein generally relates to antennas, especially relates to a smallscale multiband antenna and an electronic device with the multiband antenna.

BACKGROUND

In prior art, split antenna structure design is applied to receive and send wireless signals in different frequency bands. However, split antenna structure design has a large size, which conflicts with the miniaturization trend.

BRIEF DESCRIPTION OF THE DRAWINGS

Implementations of the present disclosure will now be described, by way of example only, with reference to the attached figures.

DETAILED DESCRIPTION

Figure 1:
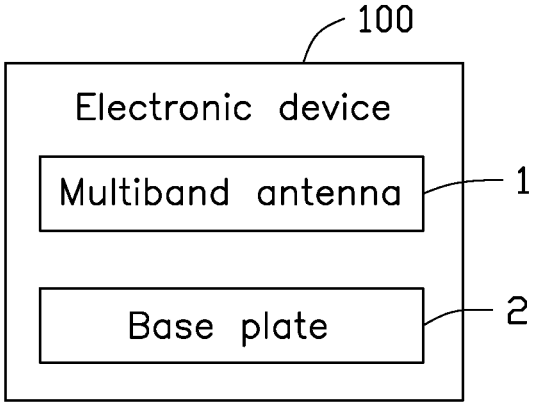
FIG. 1 is a diagrammatic view of an embodiment of an electronic device.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the exemplary embodiments described herein.

The term "comprising" means "including, but not necessarily limited to"; it specifically indicates open-ended inclusion or membership in a so-described combination, group, series, and the like.

Exemplary embodiments of the present disclosure will be described in relation to the accompanying drawings.

Figure 2:
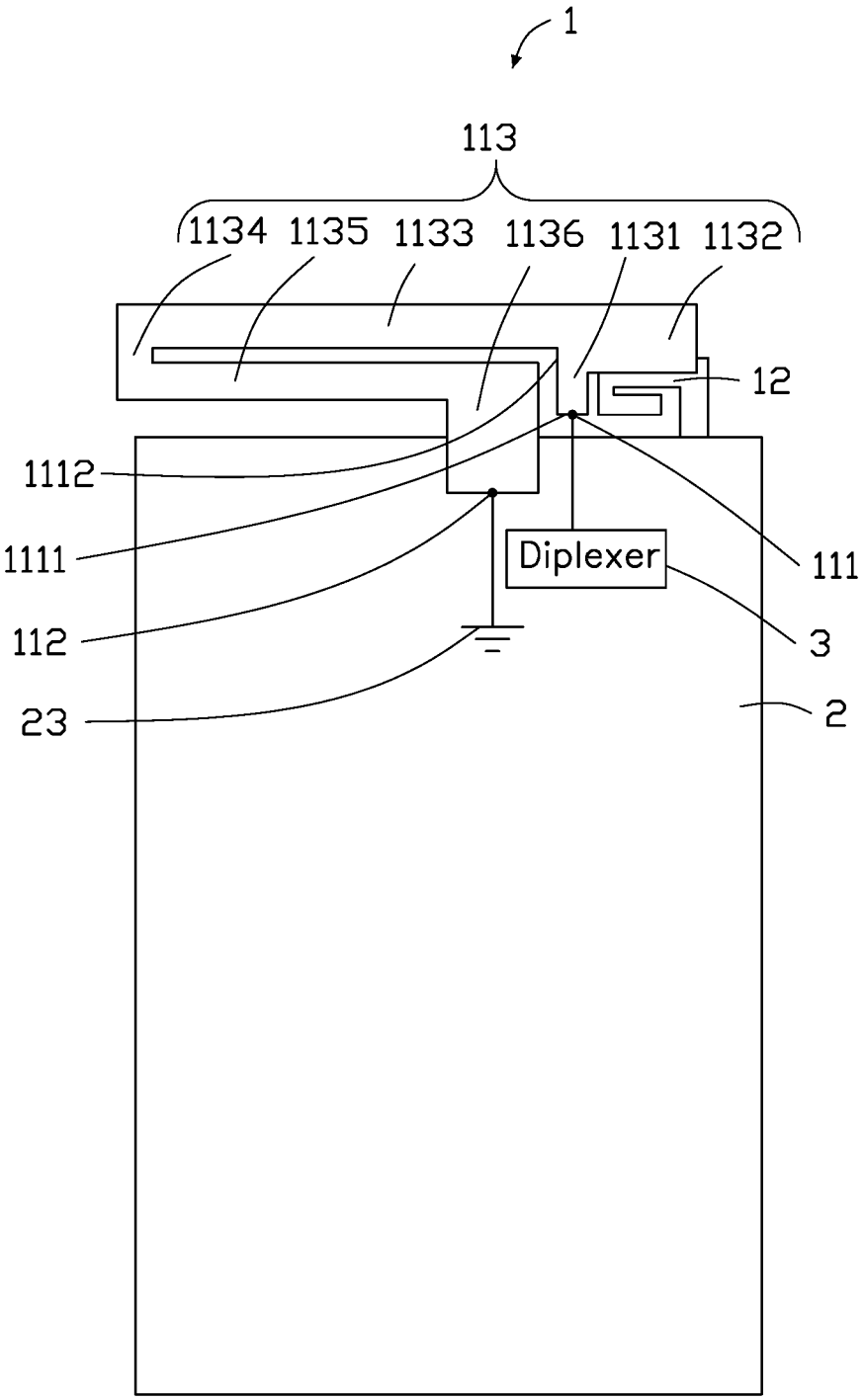
FIG. 2 is a diagrammatic view of an embodiment of a multiband antenna of the device of FIG. 1.
Figure 3:
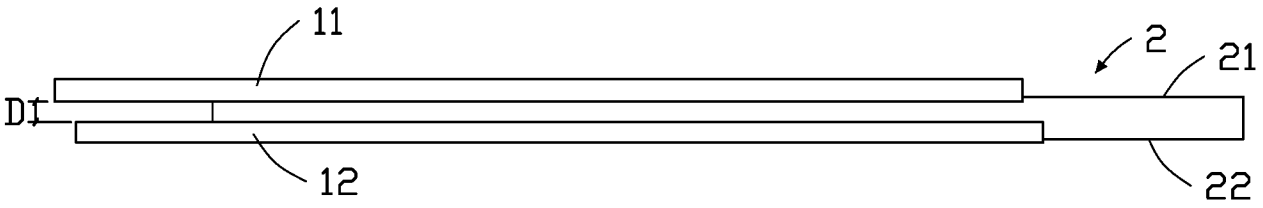
FIG. 3 is another diagrammatic view of an embodiment of the multiband antenna of FIG. 2.

FIG. 1 illustrates an electronic device 100. The electronic device includes a multiband antenna 1 and a base plate 2. In at least one exemplary embodiment, the electronic device 100 can be smart phone. FIG. 2 illustrates the multiband antenna 1. The multiband antenna 1 is set on the base plate 2. In at least one exemplary embodiment, the multiband antenna 1 is an insulation board. FIG. 3 illustrates another multiband antenna 1. The multiband antenna 1 includes, but is not limited to, a first radiating part 11 and a second radiating part 12. The base plate 2 includes a first side 21 and a second side 22 relative to the first side 21. The first radiating part 11 is set on the first side 21 of the base plate 2. The second radiating part 12 is set on the second side 22 of the base plate 2. In at least one exemplary embodiment, a gap D is formed between the first radiating part 11 and the second radiating part 12. The gap D facilitates a coupling oscillation between the first radiating part 11 and the second radiating part 12. In at least one exemplary embodiment, the coupling oscillation between the first radiating part 11 and the second radiating part 12 enables the multiband antenna 1 to work in at least one working band. In at least one exemplary embodiment, the first radiating part 11 can be a planar inverted F antenna, and the second radiating part 12 can be a unipolar antenna. The gap D between the first radiating part 11 and the second radiating part 12 is 2 mm.

In at least one exemplary embodiment, the first radiating part 11 includes a first feeding point 111, a first grounding point 112, and a first main body 113. One end of the first main body 113 connects to the first feeding point 111, the other end of the first main body 113 connects to the first grounding point 112. The first grounding point 112 connects to a common grounding end 23 of the base plate 2. In at least one exemplary embodiment, the first main body can be a "G" type antenna. The first main body 113 includes a first metal segment 1131, a second metal segment 1132, a third metal segment 1133, a fourth metal segment 1134, a fifth metal segment 1135, and a sixth metal segment 1136. The first metal segment 1131 includes a first end 1111 and a second end 1112 relative to the first end 1111. The first feeding point 111 is set on the first end 1111 of the first metal segment 1131. The second metal segment 1132 and the third segment 1133 vertically connect to the second end 1112 of the first metal segment 1131. The second metal segment 1132 and the third metal segment 1133 are located in two sides of the first metal segment 1131. The fourth metal segment 1134 vertically connects to one end of the third metal segment 1133 and is away from the first metal segment 1131. The fifth metal segment 1135 vertically connects to one end of the fourth metal segment 1134 and is away from the third metal segment 1133. The sixth metal segment 1136 vertically connects to one end of the fifth metal segment 1135 and is away from the fourth metal segment 1134. The first grounding point 112 connects to one end of the sixth metal segment 1136 and is away from the fifth metal segment 1135.

In at least one exemplary embodiment, when the multiband antenna 1 works, the first radiating part 11 and the second radiating part 12 perform the coupled oscillation. The coupled oscillation generates a first current line and a second current line on the first radiating part 11. The first current line passes through the first metal segment 1131 and the second metal segment 1132. The second current line passes through the first metal segment 1131, the third metal segment 1133, the fourth metal segment 1134, the fifth metal segment 1135, and the sixth metal segment 1136.

In at least one exemplary embodiment, the total length of the first metal segment 1131 and the second metal segment 1132 is less than one quarter of the wavelength of a radio frequency signal corresponding to a first working band of the multiband antenna 1. In at least one exemplary embodiment, the first working band is located between 2400 GHz and 2480 GHz for sending and receiving a signal of 2.4G frequency band. In at least one exemplary embodiment, the total length of the first metal segment 1131, the third metal segment 1133, the fourth metal segment 1134, the fifth metal segment 1135, and the sixth metal segment 1136 is less than one quarter of the wavelength of a radio frequency signal corresponding to a second working band of the multiband antenna 1. In at least one exemplary embodiment, the second working band is located between 5000 GHz and 5800 GHz for sending and receiving a 5G signal.

Figure 4:
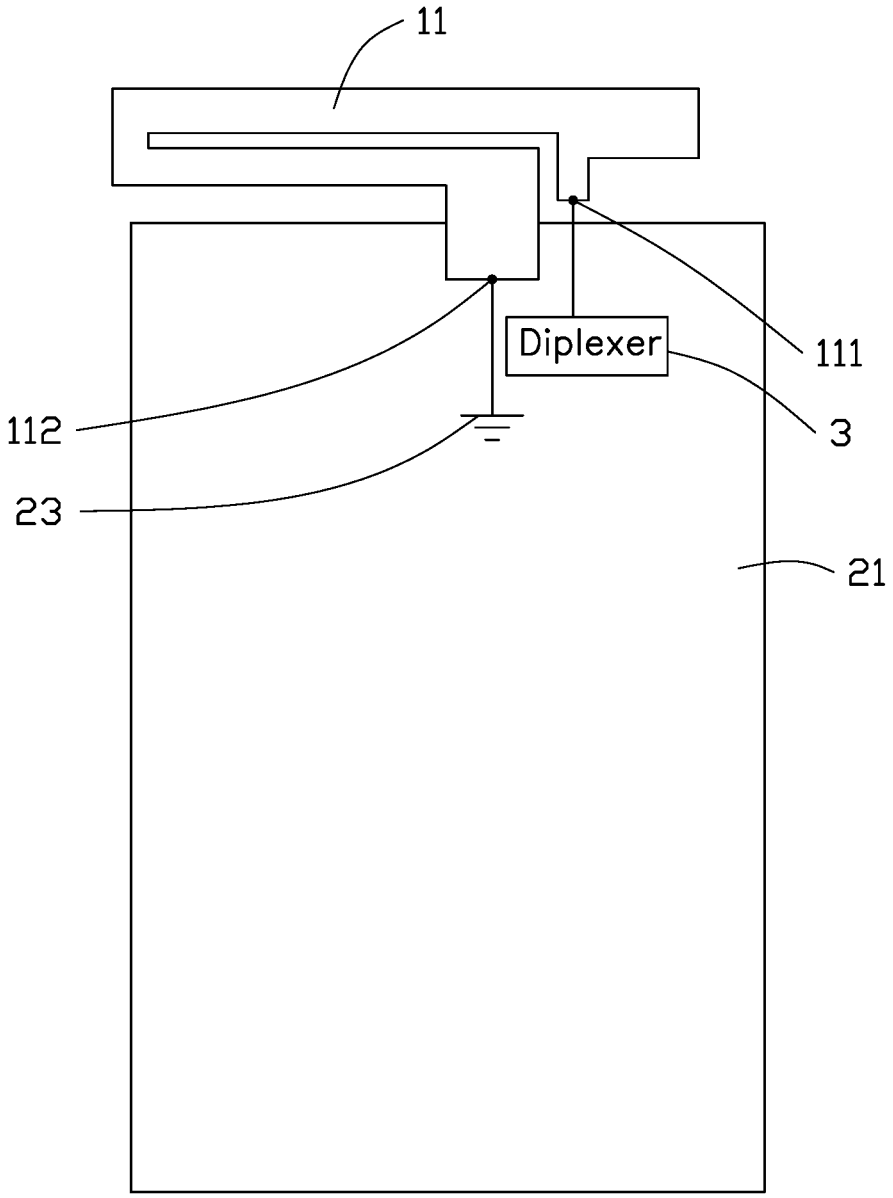
FIG. 4 is a diagrammatic view of a first side of a base plate of the device of FIG. 1.

FIG. 4 illustrates the first side 21 of the base plate 2. In at least one exemplary embodiment, the multiband antenna 1 further includes a diplexer 3. The diplexer 3 connects to the first feeding point 111 of the first radiating part 11. The diplexer 3 is used to distinguish between signals of 2.4G frequency band and of the 5G.

Figure 5:
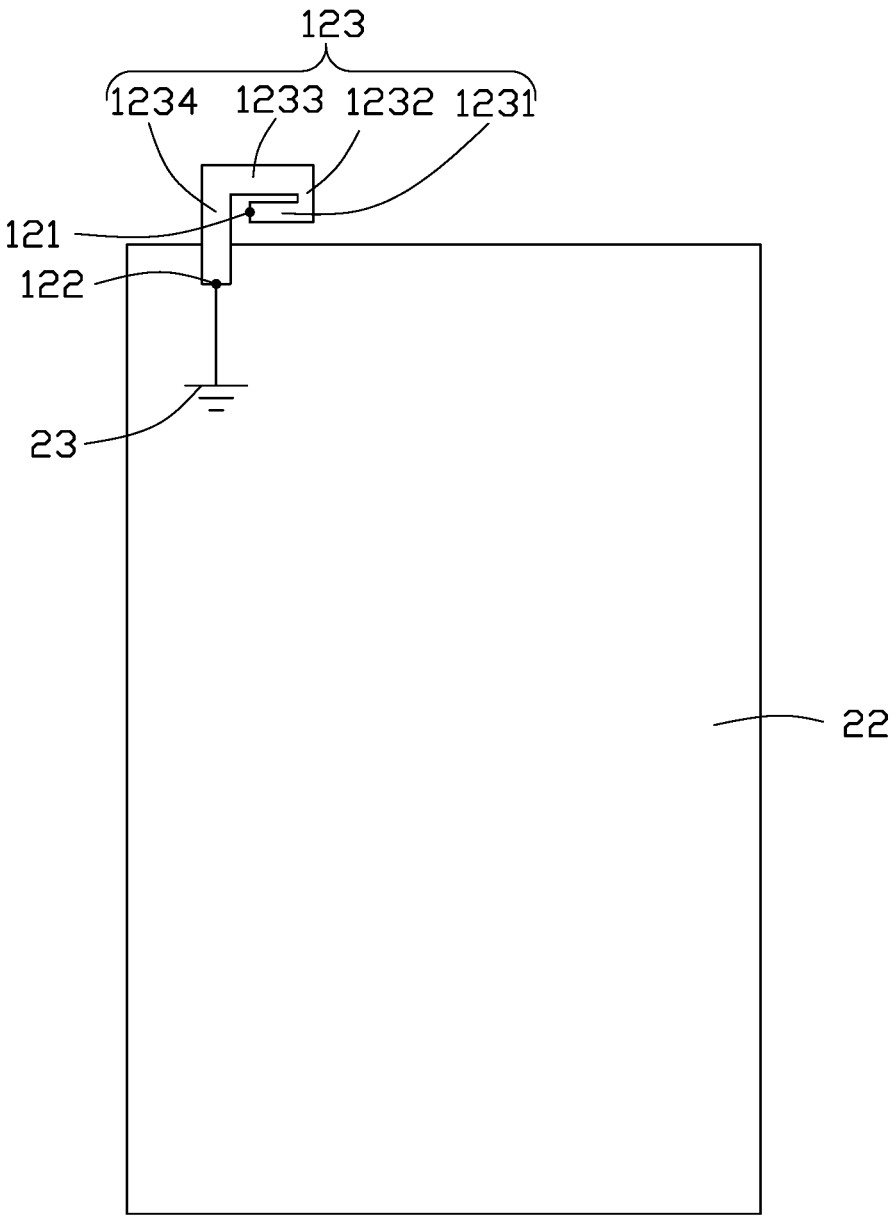
FIG. 5 is another diagrammatic view of a second side of the base plate.

FIG. 5 illustrates the second side 22 of the base plate 2. The second radiating part 12 includes a second feeding point 121, a second grounding point 122, and a second main body 123. One end of the second main body 123 connects to the second feeding point 121, the other end of the second main body 123 connects to the second grounding point 122. The second grounding point 122 connects to the common grounding end 23 of the base plate 2. In at least one exemplary embodiment, the second main body 123 can be a "G" type antenna. The second main body 123 includes a seventh metal segment 1231, an eighth metal segment 1232, a ninth metal segment 1233, and a tenth metal segment 1234. The second feeding point 121 is set on the seventh metal segment 1231. The second grounding point 122 is set on the tenth metal segment 1234. The seventh metal segment 1231 and the ninth segment 1233 vertically connect to the two ends of the eighth metal segment 1232. The tenth metal segment 1234 vertically connects to one end of the ninth metal segment 1233 and is away from the eighth metal segment 1232.

In at least one exemplary embodiment, when the multiband antenna 1 works, the first radiating part 11 and the second radiating part 12 perform the coupled oscillation, and the coupled oscillation generates a third current line on the second radiating part 12. The third current line passes through the seventh metal segment 1231, the eighth metal segment 1232, the ninth metal segment 1233, and the tenth metal segment 1234. In at least one exemplary embodiment, the total length of the seventh metal segment 1231, the eighth metal segment 1232, the ninth metal segment 1233, and the tenth metal segment 1234 is less than one quarter of the wavelength of a radio frequency signal corresponding to a third working band of the multiband antenna 1. In at least one exemplary embodiment, the third working band is located between 3400 GHz and 3600 GHz for sending and receiving signals of LTE frequency band.

The exemplary embodiments shown and described above are only examples. Even though numerous characteristics and advantages of the present disclosure have been set forth in the foregoing description, together with details of the structure and function of the present disclosure, the disclosure is illustrative only, and changes may be made in the detail, including in matters of shape, size, and arrangement of the parts within the principles of the present disclosure, up to and including, the full extent established by the broad general meaning of the terms used in the claims.

What is claimed is:

1. A multiband antenna, set on a base plate comprising a first side and a second side relative to the first side, the multiband antenna comprising:

a first radiating part set on the first side;

a second radiating part set on the second side; and a gap formed between the first radiating part and the second radiating part, wherein the gap facilitates a coupling oscillation between the first radiating part and the second radiating part, which enables the multiband antenna to work in at least one working band, wherein the first radiating part comprises a first feeding point, a first grounding point, and a first main body, one end of the first main body connects to the first feeding point, the other end of the first main body connects to the first grounding point, the first grounding point connects to a common grounding end of the base plate, wherein the first main body comprises a first metal segment, a second metal segment, a third metal segment, a fourth metal segment, a fifth metal segment, and a sixth metal segment, the first metal segment comprises a first end and a second end relative to the first end, the first feeding point is set on the first end of the first metal segment, the second metal segment and the third metal segment vertically connect to the second end of the first metal segment and are located in two sides of the first metal segment, the fourth metal segment vertically connects to one end of the third metal segment and is away from the first metal segment, the fifth metal segment vertically connects to one end of the fourth metal segment and is away from the third metal segment, the sixth metal segment vertically connects to one end of the fifth metal segment and is away from the fourth metal segment.

2. The multiband antenna according to claim 1, wherein the first radiating part generates a first current line which passes through the first metal segment and the second metal segment, and a second current line which passes through the first metal segment, the third metal segment, the fourth metal segment, the fifth metal segment, and the sixth metal segment.

3. The multiband antenna according to claim 1, wherein the total length of the first metal segment and the second metal segment is less than one quarter of the wavelength of a radio frequency signal corresponding to a first working band of the multiband antenna, the first working band is located between 2400 GHz and 2480 GHz.

4. The multiband antenna according to claim 1, wherein the total length of the first metal segment, the third metal segment, the fourth metal segment, the fifth metal segment, and the sixth metal segment is less than one quarter of the wavelength of a radio frequency signal corresponding to a second working band of the multiband antenna, the second working band is located between 5000 GHz and 5800 GHz.

5. The multiband antenna according to claim 1, wherein the multiband antenna further comprises a diplexer, the diplexer connects to the first feeding point of the first radiating part.

6. The multiband antenna according to claim 1, wherein the second radiating part comprises a second feeding point, a second grounding point and a second main body, one end of the second main body connects to the second feeding point, the other end of the second main body connects to the second grounding point, the second grounding point connects to the common grounding end of the base plate.

7. The multiband antenna according to claim 6, wherein the second main body comprises a seventh metal segment, an eighth metal segment, a ninth metal segment, and a tenth metal segment, the second feeding point is set on the seventh metal segment, the second grounding point is set on the tenth metal segment, the seventh metal segment and the ninth metal segment vertically connect to the two ends of the eighth metal segment, the tenth metal segment vertically connects to one end of the ninth metal segment and is away from the eighth metal segment.

8. The multiband antenna according to claim 7, wherein the second radiating part generates a third current line on the second radiating part which passes through the seventh metal segment, the eighth metal segment, the ninth metal segment, and the tenth metal segment, the total length of the seventh metal segment, the eighth metal segment, the ninth metal segment, and the tenth metal segment is less than one quarter of the wavelength of a radio frequency signal corresponding to a third working band of the multiband antenna, the third working band is located between 3400 GHz and 3600 GHz.

9. An electronic device comprising:

a base plate comprising a first side and a second side relative to the first side;

a multiband antenna, set on the base plate, comprising:

a first radiating part set on the first side;

a second radiating part set on the second side; and a gap formed between the first radiating part and the second radiating part, wherein the gap facilitates a coupling oscillation between the first radiating part and the second radiating part, which enables the multiband antenna to work in at least one working band, wherein the first radiating part comprises a first feeding point, a first grounding point, and a first main body, one end of the first main body connects to the first feeding point, the other end of the first main body connects to the first grounding point, the first grounding point connects to a common grounding end of the base plate, wherein the first main body comprises a first metal segment, a second metal segment, a third metal segment, a fourth metal segment, a fifth metal segment, and a sixth metal segment, the first metal segment comprises a first end and a second end relative to the first end, the first feeding point is set on the first end of the first metal segment, the second metal segment and the third metal segment vertically connect to the second end of the first metal segment and are located in two sides of the first metal segment, the fourth metal segment vertically connects to one end of the third metal segment and is away from the first metal segment, the fifth metal segment vertically connects to one end of the fourth metal segment and is away from the third metal segment, the sixth metal segment vertically connects to one end of the fifth metal segment and is away from the fourth metal segment.

10. The electronic device according to claim 9, wherein the first radiating part generates a first current line which passes through the first metal segment and the second metal segment, and a second current line which passes through the first metal segment, the third metal segment, the fourth metal segment, the fifth metal segment, and the sixth metal segment.

11. The electronic device according to claim 9, wherein the total length of the first metal segment and the second metal segment is less than one quarter of the wavelength of a radio frequency signal corresponding to a first working band of the multiband antenna, the first working band is located between 2400 GHz and 2480 GHz.

12. The electronic device according to claim 9, wherein the total length of the first metal segment, the third metal segment, the fourth metal segment, the fifth metal segment, and the sixth metal segment is less than one quarter of the wavelength of a radio frequency signal corresponding to a second working band of the multiband antenna, the second working band is located between 5000 GHz and 5800 GHz.

13. The electronic device according to claim 9, wherein the multiband antenna further comprises a diplexer, the diplexer connects to the first feeding point of the first radiating part.

14. The electronic device according to claim 9, wherein the second radiating part comprises a second feeding point, a second grounding point and a second main body, one end of the second main body connects to the second feeding point, the other end of the second main body connects to the second grounding point, the second grounding point connects to the common grounding end of the base plate.

15. The electronic device according to claim 14, wherein the second main body comprises a seventh metal segment, an eighth metal segment, a ninth metal segment, and a tenth metal segment, the second feeding point is set on the seventh metal segment, the second grounding point is set on the tenth metal segment, the seventh metal segment and the ninth metal segment vertically connect to the two ends of the eighth metal segment, the tenth metal segment vertically connects to one end of the ninth metal segment and is away from the eighth metal segment.

16. The electronic device according to claim 15, wherein the second radiating part generates a third current line on the second radiating part which passes through the seventh metal segment, the eighth metal segment, the ninth metal segment, and the tenth metal segment, the total length of the seventh metal segment, the eighth metal segment, the ninth metal segment, and the tenth metal segment is less than one quarter of the wavelength of a radio frequency signal corresponding to a third working band of the multiband antenna, the third working band is located between 3400 GHz and 3600 GHz.

* * * * *